United States Patent [19]

Doerfel

[11] Patent Number: 4,722,490

[45] Date of Patent: Feb. 2, 1988

[54] METHOD AND APPARATUS FOR WINDING ROLLS OF PAPER

[75] Inventor: Gerhard W. Doerfel, Boll, Fed. Rep. of Germany

[73] Assignee: Beloit Corporation, Beloit, Wis.

[21] Appl. No.: 937,571

[22] Filed: Dec. 3, 1986

[30] Foreign Application Priority Data

Dec. 3, 1985 [DE] Fed. Rep. of Germany ..... 3542633

[51] Int. Cl.[4] ..... B65H 18/10; B65H 23/04

[52] U.S. Cl. ..... 242/67.3 R; 242/75.51

[58] Field of Search ..... 242/67.1 R, 67.3 R, 242/67.5, 56.4, 56.5, 56.6, 75.5, 75.51, 75.52, 75.53

[56] References Cited

U.S. PATENT DOCUMENTS 3,241,785 3/1966 Barrett ..... 242/75.51
3,535,441 10/1970 Grace ..... 242/75.51 X
3,701,493 10/1972 Welsch et al. ..... 242/75.51 X
3,871,598 3/1975 Kataoka ..... 242/75.51
3,987,611 10/1976 Kitamura et al. ..... 242/45 X
4,342,432 8/1982 Lund et al. ..... 242/56.4 X
4,393,701 7/1983 Lawson ..... 242/75.5 X
4,458,467 7/1984 Shulman et al. ..... 242/75.51 X

FOREIGN PATENT DOCUMENTS 2256882 8/1977 Fed. Rep. of Germany .

*Primary Examiner*—John M. Jillions
*Attorney, Agent, or Firm*—Dirk J. Veneman; Raymond W. Campbell; David J. Archer

[57] ABSTRACT

An apparatus and method wherein, with continuous measurement of the stretch directly on the web itself and by controlling the unwinding and winding-up speed in the winding-up roll, a predetermined stretch profile in relation to winding diameter is produced, in order to achieve a quality of roll which is as uniform as possible and constant with time.

10 Claims, 5 Drawing Figures

METHOD AND APPARATUS FOR WINDING ROLLS OF PAPER

The invention relates to a method and apparatus for rewinding paper webs.

The manufacture of a trouble-free wound roll of paper for printing purposes, for example a roll of newsprint, with a core diameter of 8 to 15 cm and an outside diameter of about 1 to 1.5 meters, which does not "work" in the course of time, and which, on unwinding and introduction into the printing machine, exhibits uniform characteristics of the web throughout, is difficult to achieve even today. The reason lies in the very complex tension/stretch relationship and behavior of the paper over time. Paper shows clear elasto-plastic characteristics; and, on the one hand, in the short term of fractions of a second, it shows recovery characteristics, whilst on the other hand, in the long term of a few days, it has a tendency to creep.

This behavior leads to the fact that the winding of rolls with constant winding tension as practiced everywhere today does not always produce satisfactory results. The maintenance of constant tension during winding up does not lead with any certainty to the consequence of a constant amount of stretch on unwinding under constant tension. On the contrary, different portions of the paper web at the same tension expand to a different degree, and as they pass through the printing machine they show different degrees of recovery, creating problems in maintaining registration.

With regard to the "working" of the roll of paper in the course of time, an important factor in this is that in a roll which has been wound up with constant web tension, i.e. longitudinal tension, this longitudinal tension is outweighed in the interior of the roll by longitudinal compressive forces, which leads to a condition of hoop stress produced at a given point by the layers of paper which have been wound around outside it under longitudinal tension. Just as in a container in which internal pressure gives rise to a hoop stress in the form of a tension load acting circumferentially, the wall experiences, in the presence of an external pressure acting on the container, a hoop stress in the form of a compressive load. The compressive stress of this example of the container corresponds to the longitudinal compressive stress which is produced in the paper web by the outer layers. It can be shown that by the elasto-plastic behavior of the paper in conjunction with its tendency to creep, i.e. the reduction in stress over long periods of time, the longitudinal compressive stresses in the paper web increase at the expense of the wound-in longitudinal tensile stress and they finally prevail so that the inner layers of paper, although they were originally wound under tension, are subjected to a resulting load in the form of a longitudinal compressive stress, which they try to oppose. It is true that the layers of paper are held against one another by friction but movement of the paper can be caused by other factors, for example by the plastic deformation defined as creep. The individual layers then begin to slide over one another and radial zones can arise in the roll in which the paper is particularly strongly squeezed together, or indeed deformed into a wavy shape. Such paper can no longer be used for newsprint.

The problem of bagginess, i.e. the stretch of the paper web which is non-uniform over the surface, also comes into play, and is produced by internal movements in a roll of paper regardless of whether they arise on winding, on unwinding or in storage. This leads to damage in the form of bulges, over-stretching and so on. Also, it adversely affects the uniformity of the characteristics of the paper over the length of the web.

The present invention is based on solving the problem of improving the uniformity of the mechanical condition of the paper web when it is unwound from a roll in use.

This problem is solved according to the invention by directly measuring and controlling the stretch of the web, in relation to the winding diameter.

The driving motors of the winding-up roll and the unwinding roll are therefore controlled in mutual interdependence in such a way that the winding-up motor accelerates slightly in advance of the unwinding motor, so that the length of web which is between them is slightly stretched by an accurately adjustable amount which is monitored directly on the web, i.e. without doing it indirectly via measurement of the tension. Such indirect measurement may be affected by very widely differing factors which alter the local Young's modulus (E) of the web, for example varying moisture content levels. Therefore, for a given tension, entirely different amounts of stretch can arise at different points. Since the amount of stretch is important on unwinding and for the stability of the roll, this factor is employed as the guiding factor, according to the invention, on winding up as well. In terms of apparatus, this is more difficult than simply maintaining a predetermined tension.

The measurement of the degree of stretch of the web of paper directly at the web itself on unwinding is known from DE-PS No. 22 56 882.

West German Pat. No. 2256882 issued Aug. 11, 1977, teaches a paper web tension controlling device which is disposed in front of a processing machine so that damage to the processing machine by the web splice is inhibited. The device includes a feed cylinder which proceeds the processing machine. The speed of the feed cylinder is altered by a controller when the tension value departs from the preset value for a selected web tension coefficient whereby the tension value is arrived at using a computer which compares the ratio of the products of the web tension and speed in front and after the feed cylinder. This is achieved by counting pulses, i.e. by speed measurement at two points spaced apart in the direction of travel, by means of rollers through which the web runs and which drive the pulse counters. At the same time, the tension in the web is measured at both points. The stretch of the paper web is regulated in accordance with a predetermined relationship between the speeds and the tensions, given in the form of a mathematical formula. However, this device is placed ahead of the introduction into a working machine which uses the paper web, and it has nothing to do with the manufacture of rolls of paper.

In the adjustment of the stretch undertaken in accordance with the invention the amount of stretch does not necessarily have to be increased as it comes off the unwinding roller; it may also be desirable in certain cases to let the web give a bit, i.e. to reduce the stretch.

The variation in the amount of the stretch over the winding diameter, i.e. the stretch at different points in the roll, adjusted to be more in the inner region or more in the outer region, is to be capable of choice at will. Indeed, a limiting case within the scope of the invention is one in which the wound-in stretch is held constant over the entire roll However, a predetermined program of expansion or stretching over the diameter is preferred, orientated towards the desired characteristics of the finished and, if necessary stored, roll. These desired characteristics include the stability of the roll which therefore should not "work" so much in the course of this that the quality of the roll is poor, and they include a uniform amount of stretch on unwinding.

The stretching program on winding depends on a number of influencing factors, such as the kind of material used, its moisture content, the diameter of the roll and so on, and it must be programmed by the expert in each individual case.

Winding programs for rolls of paper in which magnitudes other than the stretch are controlled are known in themselves. In the publication "Wochenblatt fur Papierfabrikation" Number 13 (1975) pages 487–490 there is a discussion of the regulation of the winding hardness defined as pressure inside the roll of paper, which is influenced by the engaging force of the winding roller and by the web tension, and which is designed to have, over the diameter of the roll, a somewhat S-shaped course, with a steep rise towards the center of the roll and a marked reduction towards the surface of the roll. In the known construction the drive is achieved solely from the periphery of the roll, which means that on account of the absence of transmission of torque from the core to the inside of the roll, i.e. in the region near the core, there is practically no web tension built up and therefore also no stretch, and accordingly it cannot be controlled.

It is of advantage to determine in relation to one another the dimensions of the apparatus, i.e. the spacing between the winding up point and the unwinding point with respect to the speed of the web. As already explained earlier, paper shows a certain recovery time, i.e., within its elastic behavior pattern, a paper web which is under tension does not return suddenly to zero extension when the tension ceases, but it requires a certain amount of time for this to happen, which lies in the order of magnitude of about one-half second. Thus, when a given element of the paper web arrives at the winding up point less than one-half second after leaving the unwinding point, and thus before recovery is complete, an indeterminate degree of stretch is wound into the new roll, destroying the planned program of the stretch. Therefore, according to the invention the recovery should have time to be completed before a given element of the web reaches the winding-up point.

Two spaced apart measuring devices are provided for measuring the length of paper passing during a predetermined time interval. The second measuring device in the direction of travel should be arranged directly at the winding-up point, thereby to ascertain the stretch present at the roll itself, with further changes in the stretch after measurement being eliminated.

An embodiment of the invention by way of example is illustrated in the drawings.

Figure 1:
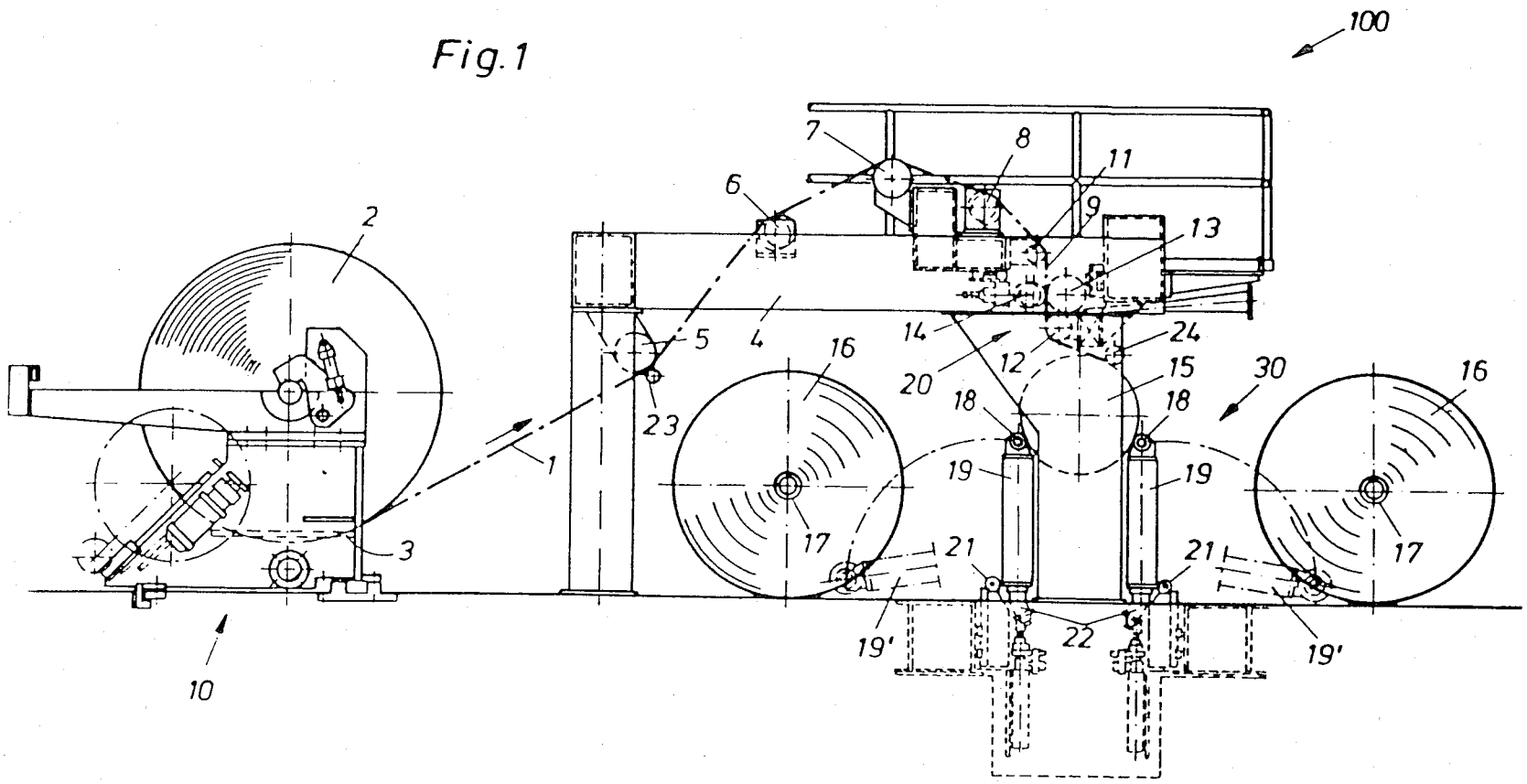
FIG. 1 shows a side elevation of a roll-cutting machine according to the invention.

The roll-cutting machine indicated in FIG. 1 as a whole at 100 includes an unwinding station 10, a cutting station 20 and a winding-up station 30. In the unwinding station 10 the paper web 1 is unwound from the unwinding drum or roll 2, which can be a roll coming from the papermaking machine, with a length up to about 10 meters and a diameter up to about 2,500 mm. The unwinding roll 2 is driven in a controlled manner. The paper web 1 leaves the unwinding roll 2 at an unwinding point 3.

The cutting station 20 is arranged with the associated guide rollers and lateral control rollers on a machine frame 4 which is in the form of a portal frame extending in the direction of travel of the web, and which extends transversely over the width of the web. After leaving the unwinding point 3 the web 1 passes over a guide roller 5, a lateral control roller 6, a guide roller 7, a further lateral control roller 8 and, in a vertically downwardly extending portion 9, mutually superimposed guide rollers 11, 12, between which is provided the longitudinal cutting device in the form of the co-operating rotary knives 13,14. The longitudinally slit web then passes to the winding up roller 15 on which the slit sections of partial web width are wound up to form the wound-up rolls 16. The rolls 16 are wound onto bobbins or cores 17, the ends of which are engaged by clamping heads 18 carried on supporting arms 19 which can pivot about pivot points 21 at ground level. The bobbin 17 is as long as the width of one slit web section. The clamping heads 18 on the arms 19 are provided at both ends of the bobbins 17. The supporting arrangements 18, 19 for adjacent slit web sections are arranged on opposite sides of the winding up roller 15, and are each mutually displaced with respect to one another by a distance equal to the width of a slit web section in the direction of the axis of the roller 15, i.e. perpendicular to the plane of the drawing in FIG. 1. In this way all the part-webs into which the web 1 has been sub-divided are wound up simultaneously. The supporting devices 18, 19 do, in fact, extend beyond the edges of the part-webs but do not get in the way of the adjacent part-webs because adjacent part-webs are wound on different sides of the winding up roller 15.

In FIG. 1 the supporting arms 19 are shown raised to the upright position, corresponding to the start of winding. The clamping heads 18 are driven by hydraulic motors 22. Thus, the winding takes place from a central drive, which is an important pre-requisite for winding with controlled stretching of the web. Where the winding is done with a peripheral drive only small degrees of stretch can be achieved in the inner part of the roll. When the diameter of the wound-up roll 16 grows, the supporting arms 19 swing outwards into the positions indicated. When the desired winding diameter has been reached, the arms 19 are lowered further until the wound-up rolls 16 engage the floor. Then the clamping heads 18 release the bobbins 17, and the wound-up rolls 16 can be rolled away laterally. This condition of the wound-up rolls 16 is illustrated in full lines in FIG. 1. The arms 19 are then lowered still further into the position indicated in broken lines at 19', in which they are fitted with new bobbins 17.

Finally the arms 19 with the bobbins 17 are raised again to engage the winding up roller 15.

Against the guide roller 5 and the winding up roller 15 lie measuring rollers 23 and 24 so that the web passes between the pairs of rollers 5,23 and 15,24, and a reliable non-slip engagement of the measuring rollers is achieved. The measuring rollers 23,24 are connected to pulse generators 25, 26 respectively having a fine graduation, i.e. a high pulse rate, which give a predetermined high number of pulses per revolution, which is the same in both rollers 23 and 24. When the number of pulses delivered per unit time by the rollers 23 and 24 are compared, the stretch of the web between the points 5,23 and 15,24 can be determined, as the length of the portion of the web between the points 5,23 and 15,24 is known accurately. This measured stretch or expansion serves for controlling by control device 27 the driving of the unwinding roll 2 and the wind-up roll 16 in mutual dependence in such a way that a predetermined course or program of the stretch wound in the wind-up roll 16 can be maintained; for example a constant degree of stretch, or an amount which is variable throughout the diameter of winding in accordance with a prearranged program.

The roll 2 to be unwound has been wound up in the papermaking machine also under a predetermined tension. The degree of stretch under stress will have changed during storage, but one can take as a starting point that in the paper web of the roll 2 certain portions with a degree of elastic longitudinal stretch are still present. These portions will be completely deformed if the unwinding roll 2 is unwound without tension. However, this does not occur in practice.

Figure 2:
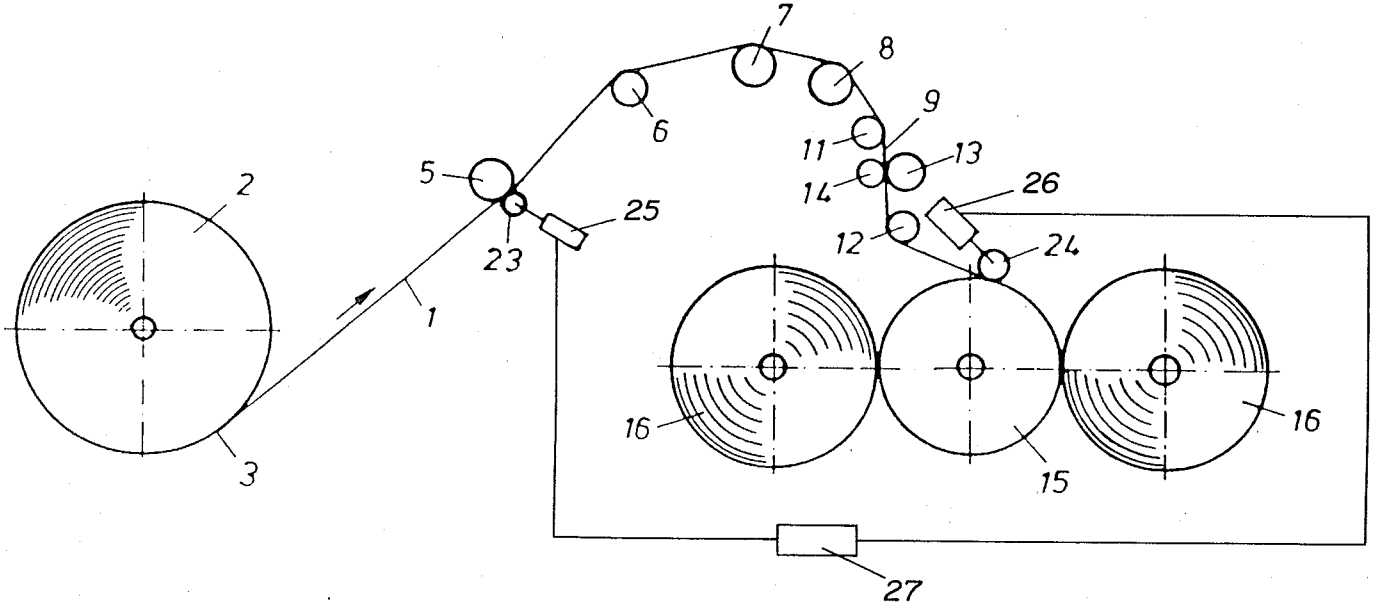
FIG. 2 shows a diagrammatic side elevation of the arrangement according to FIG. 1, with only the important elements shown.

On the contrary, the tension applied by the hydraulic motor drives 22 causes a predetermined tension and stretch between the rolls 2 and 16. When the tension thereby produced between the unwinding point 3 and the point 5,23 is high, the stretch introduced into the paper web will increase. When it is relatively low, the corresponding part of the elastic residual stretch of the paper web 1 will decrease. However, neither alteration in the stretch occurs suddenly, but on the contrary will require a certain recovery time, which is shown in the diagram in FIG. 3. It can be seen from this that both the increase in the amount of stretch on the application of different levels of tension (which are given in the diagram in Newtons per meter of paper width) and also on relief from the corresponding tension conditions to the limiting tension, which is zero, do not reach their final value suddenly, but only after a predetermined time which, in the example illustrated, lies in the region of about 0.3 to 0.4 seconds. In practice, in the roll-cutting machine shown in FIGS. 1 and 2, the recovery goes more rapidly than indicated as it is concerned not with recovery from a maximum value down to zero or a very high different value but only with recovery through a partial amount which correspondingly requires only a fraction of the time, read from FIG. 3, in the range of 0.3 to 0.4 seconds.

The arrangement and control should be adjusted in relation to one another so that the recovery of the stretch "wound-in" by the unwinding roll 2 is completed before a given portion of the paper web has reached the point 15,24. Otherwise, the residual stretch present in the unwinding roll 2 which has still not quite recovered will again be wound in, and the stretch measured between the points 5,23 and 15,24 will not agree with the actual stretch of the paper web on the wind-up roll 16. A corresponding control must take into account the stretch caused by the spacing determined by the machine, between the unwinding point 3 and the point 15,24 and the stretch effected by the relationship of the driving speeds of the wind-up rolls 16 and the unwinding roll 2.

Figure 3:
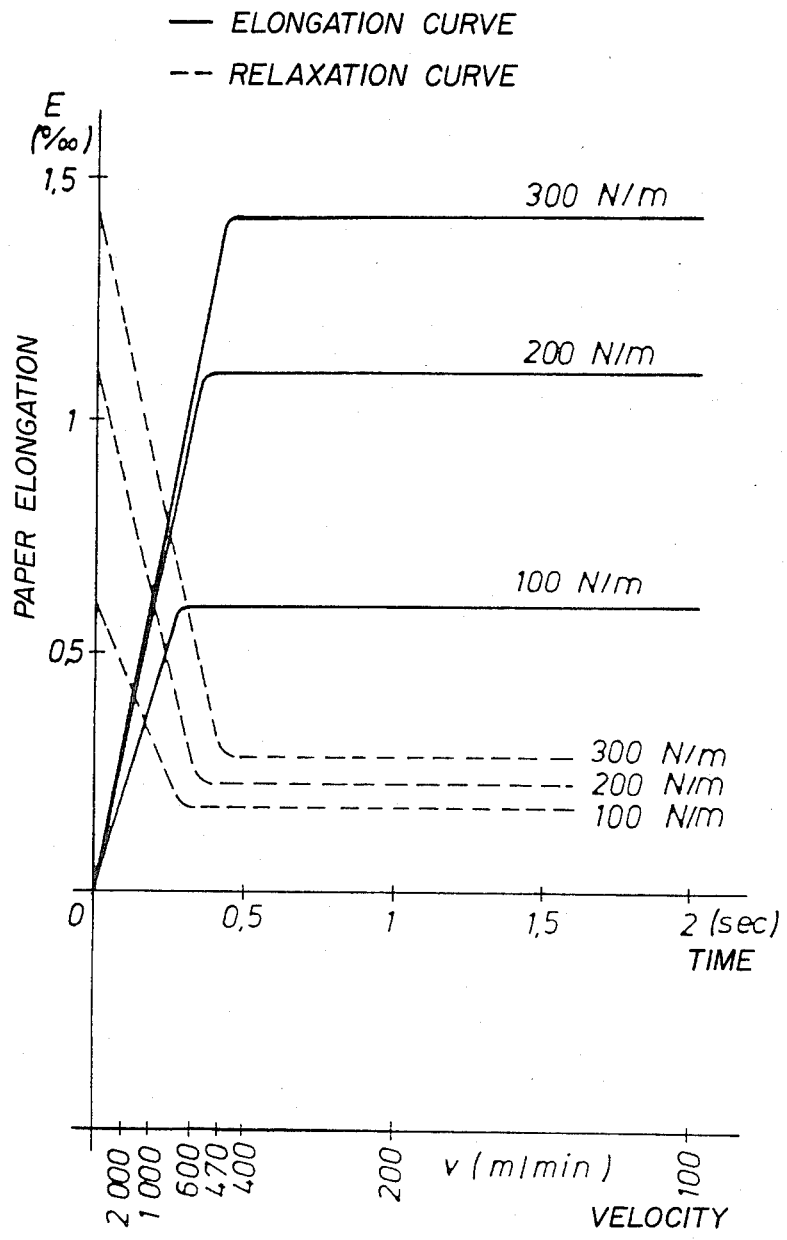
FIG. 3 shows a graph of the recovery behavior of a paper web.

In FIG. 3 there is also indicated a second abscissa scale which corresponds to a spacing of the points 3 and 15,24 of 3.33 meters. For passing through this distance at a speed of 100 meters per minute the web needs two seconds. In this period of time all the residual stretch present in the web coming from the unwinding roller 2 will have dissipated. It becomes critical in the region of about 600 meters per minute. At this speed the web needs a period of time for passing through a length of 3.33 meters which lies in the range of the recovery times of 0.3 to 0.4 seconds, so that, in some circumstances, at high web speeds, complete recovery will not have had time to take place at point 24. However, this does not arise in practice, as there is hardly ever complete recovery but only partial recovery from an actual value of the amount of stretch to a theoretical value lying above or below it. For this purpose only a short interval of time is necessary, and this is not exceeded as the web passes through the length 15,24.

Figure 5:
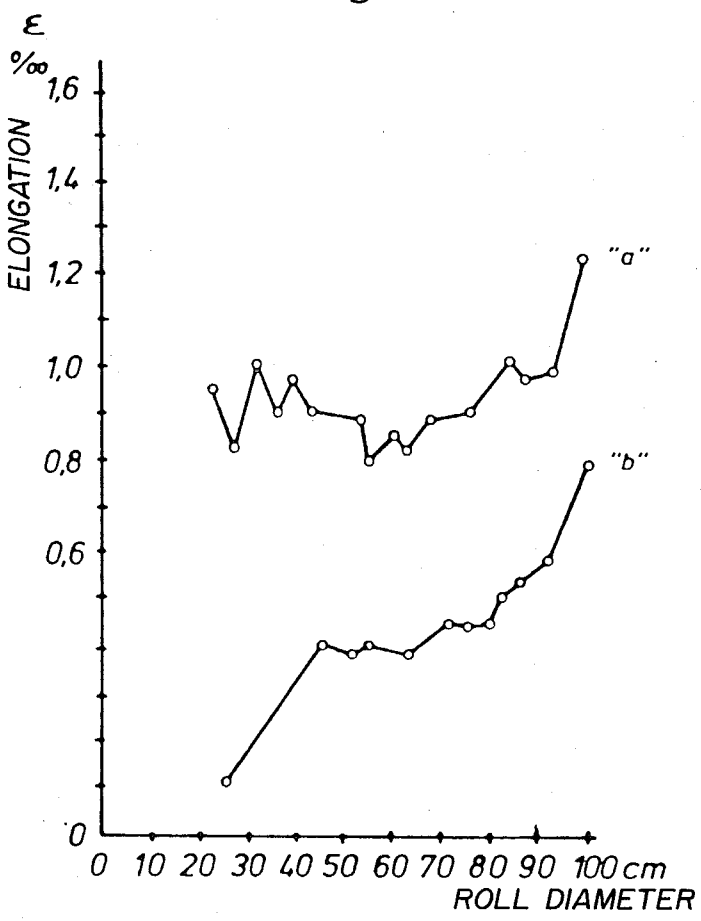
FIGS. 4 and 5 show the results of comparative tests in the form of the program of stretch over the diameter of the roll.
Figure 4:
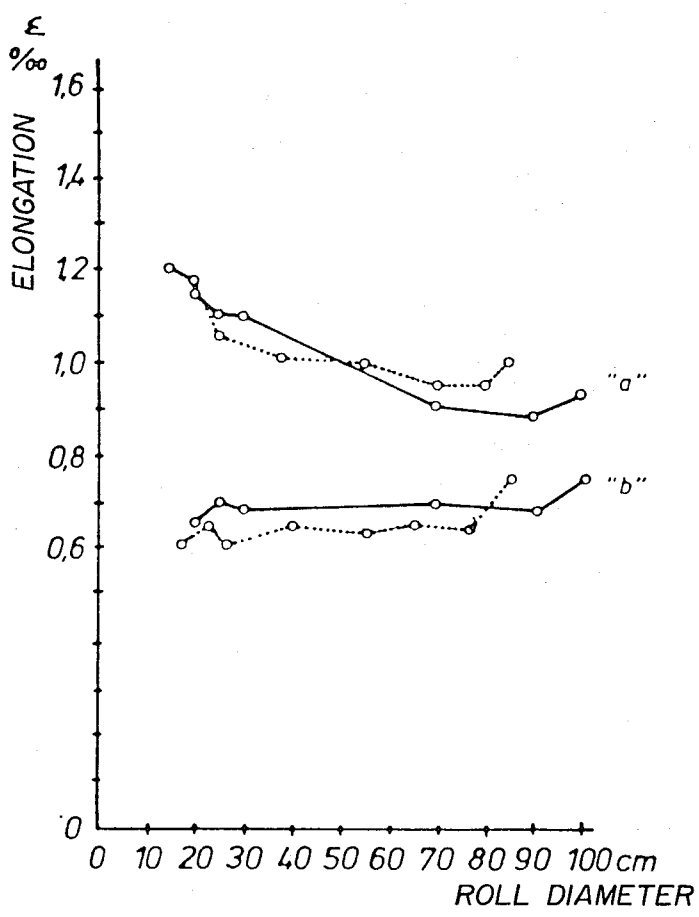

FIGS. 4 and 5 show test results which were obtained in the winding of rolls on the same machine. They illustrate the pattern of the degree of stretch in relation to the diameter of the roll. The curves thus illustrate what amount of stretch is present at a given radial point on a roll. The measurements were taken in accordance with the so-called gap test in which the stretch is determined by making a cut in the outer layers of the paper web parallel to the axis and measuring the width of the resulting gap.

The measurements corresponding to curves "a" were carried out directly after the manufacture of a roll. The curves "b" give the pattern of the stretch after seven days, when the creep behavior of the paper has had time to take effect. The condition "b" corresponds to the normal condition of use of the wound roll, for example, in which it is delivered to a printing machine. Normally a certain period of time does indeed pass between the manufacture of the roll and its use. The creep takes place in the first few days. The further changes which take place after seven days have passed, i.e. subsequent to the time at which the curves "b" were taken, are no longer significant.

In FIG. 4 there are two of each of the curves "a" and "b". The roll shown in full lines had a diameter of about 100 cm whilst the roll corresponding to the dotted-line curve had a diameter of about 80 cm.

During winding of the roll the stretch was controlled in accordance with a predetermined program so that directly after winding the stretch profile across the diameter of the roll was that indicated at "a".

After the roll had "set" the stretch profiles "b" were present, i.e. a degree of stretch which was practically uniform over the whole of the diameter of the roll, within the limits of measuring accuracy, with a slight rise in the neighborhood of the surface. This uniform stretch substantially simplifies the use of the roll, for example in a printing machine.

For purposes of comparison there are contrasted in FIG. 5 the stretch profiles of a roll of about 100 cm diameter which was wound under constant tension. The curve "a" gives the stretch profile directly after formation of the roll and the curve "b" shows the profile after about seven days, corresponding to the state in which the roll is put to use.

It can immediately be seen that the stretch in the curve "b" changes to a much greater extent, i.e. it rises towards the outside, than is the case in the curve "b" in FIG. 4.

The method and apparatus for rewinding webs which have been disclosed herein may be changed without departing from the scope of the present invention.

What is claimed is:

1. Apparatus for rewinding paper webs comprising:

a driven unwinding device;

a centrally driven winding-up device; and a control device by means of which the speeds of the unwinding device and the winding up device are adjustable in mutual dependence, characterized in that:

the winding up device (30) has connected ahead of it a measuring arrangement (23,24) engaging the web (1) directly for determining the actual stretch of the portion of the web being wound up;

the spacing between an unwinding point (3) of the unwinding device and a winding up point (15,24) of the winding up device being so large that a first time interval needed for a section of the web to pass between said points is larger than a second time interval corresponding to the recovery time of the web so that during rewinding, when the web is stretched, the web has sufficient time to recover from the stretched condition prior to being wound onto said winding up device.

2. Apparatus according to claim 1, characterized in that the measuring arrangement (23,24) comprises two measuring devices arranged spaced apart by an accurately determined amount, for measuring the length of web passing through in a predetermined time interval.

3. Apparatus according to claim 1, characterized in that the measuring arrangement (23,24) comprises two measuring devices arranged spaced apart by an accurately determined amount, for measuring the length of web passing through in a predetermined time interval.

4. Apparatus according to claim 2 characterized in that the measuring devices comprise a measuring roller rolling in contact with the web (1), and a fine-graduation pulse generator operated by said measuring roller.

5. Apparatus according to claim 3, characterized in that the measuring devices comprise a measuring roller rolling in contact with the web (1), and a fine-graduation pulse generator operated by said measuring roller.

6. Apparatus according to claim 2, characterized in that the second measuring device (24) looking in the direction of travel is arranged near the winding-up point.

7. Apparatus according to claim 3, characterized in that the second measuring device (24) looking in the direction of travel is arranged near the winding-up point.

8. Apparatus according to claim 4, characterized in that the second measuring device (24) looking in the direction of travel is arranged near the winding-up point.

9. Apparatus according to claim 5, characterized in that the second measuring device (24) looking in the direction of travel is arranged near the winding-up point.

10. An apparatus for rewinding a paper web, said apparatus comprising:

a driven unwinding device;

a centrally-driven winding up device, said winding up device being disposed downstream relative to said driven unwinding device such that the web is unwound from said unwinding device and is wound onto said winding up device;

a control device for controlling the relative speeds of rotation of said unwinding the winding up devices;

measuring means cooperating with the web and disposed between said unwinding and winding up devices for measuring the actual stretch of a portion of the web disposed between said unwinding device and said measuring means; and said unwinding device and said winding up device being disposed at a distance such that a first time interval is required for said portion to pass from said unwinding to said winding up device, said first time interval being greater than a second time interval required for said portion to recover from a stretched to an unstretched condition of the web such that when the web is wound onto the winding up device, the web is unstretched thereby inhibiting wrinkling of the resultant rewound web.

* * * * *